United States Patent [19]

Kluge

[11] Patent Number: 5,018,302

[45] Date of Patent: May 28, 1991

[54] BURGLAR BAR SAFETY LATCH ASSEMBLY

[75] Inventor: Richard G. Kluge, Pell Lake, Wis.

[73] Assignee: John Sterling Corporation, Richmond, Ill.

[21] Appl. No.: 564,199

[22] Filed: Aug. 8, 1990

[51] Int. Cl.[5] ..... E06B 3/68

[52] U.S. Cl. ..... 49/56; 49/55; 49/141; 49/379; 49/394; 292/DIG. 72; 292/304

[58] Field of Search ..... 49/56, 55, 57, 50, 141, 49/394, 395, 379; 292/DIG. 72, DIG. 55, 304, 302

[56] References Cited

U.S. PATENT DOCUMENTS

| | | | |
|---|---|---|---|
| 1,960,015 | 5/1934 | Kitzelman | 49/56 X |
| 4,680,890 | 7/1987 | Jokel | 49/55 |
| 4,685,316 | 8/1987 | Hicks et al. | 49/141 X |
| 4,793,098 | 12/1988 | Wilkerson | 49/55 |
| 4,796,384 | 1/1989 | Warwick | 49/56 X |

*Primary Examiner*—Philip C. Kannan

*Attorney, Agent, or Firm*—McCaleb, Lucas & Brugman

[57] ABSTRACT

A burglar bar assembly for establishing a security barrier across a door or window opening composed of a plurality of horizontal cross bars held in vertically spaced relation by intervening and transversely related vertical members. Certain of the vertical members are fixed rigidly to certain of the cross bars, but slidably joined to others in a manner to provide for extension and retraction adjustment of the barrier to accomodate variations in door or window dimensions. The bar assembly is hingedly connected at one end to a window or door frame to provide for swinging opening and closing operation of the barrier. A safety latch is mounted adjacent one end of the bar assembly and comprises a spring loaded cam member pivotally moveable against spring bias by a remotely operated cable. The cam member serves to capture and lock the unhinged end of the barrier to a rigid locking channel secured to the window or door frame; such channel having spaced angulated slots receptive of the cross bars. Releasing operation of the cam member permits the cross bars to escape from the locking channel slots by force of gravity. The cam is also arranged to automatically retract and lock the cross bars in the angulated slots of the locking channel in response to movement of the bar assembly to a closed position over the window or door opening.

7 Claims, 3 Drawing Sheets

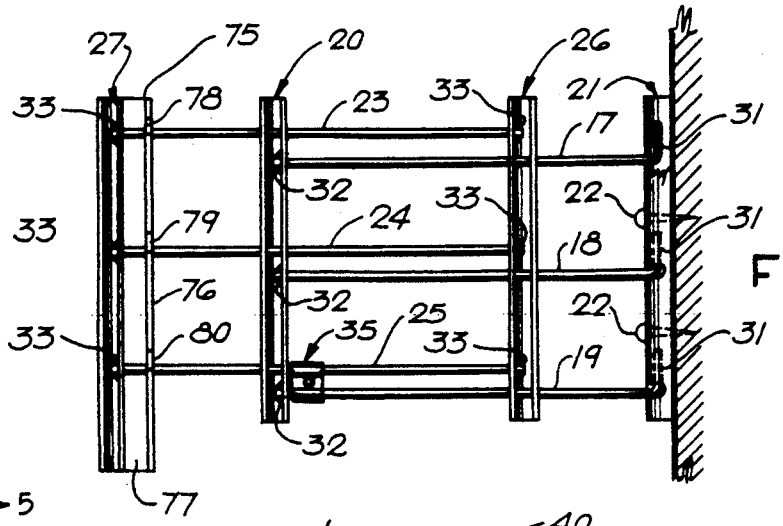
FIG. 2
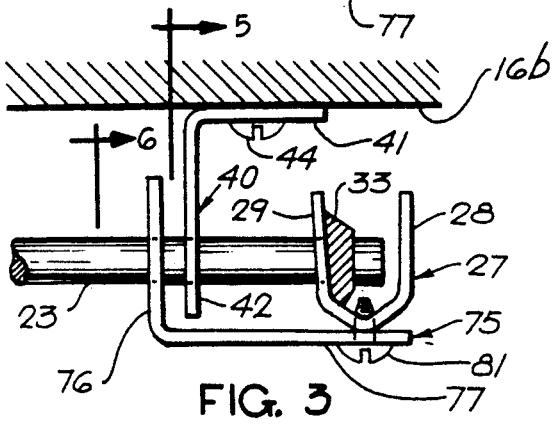
FIG. 3
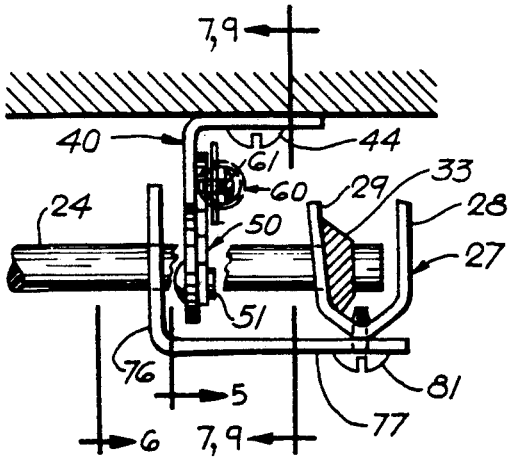
FIG. 4
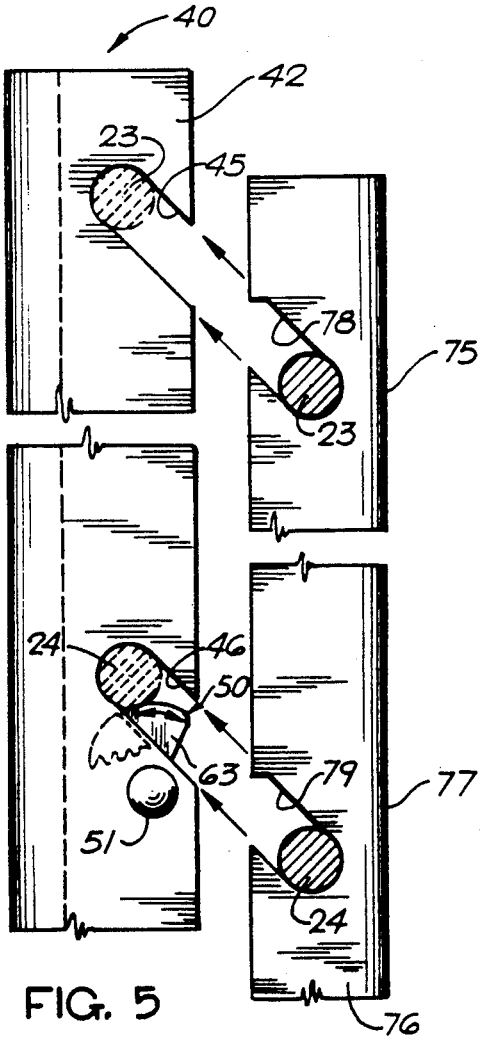
FIG. 5
FIG. 6

BURGLAR BAR SAFETY LATCH ASSEMBLY

This invention relates generally to burglar bar assemblies for establishing security barriers across window, door or similar openings in a building structure. More particularly the invention relates to an improved latching mechanism for automatically locking and releasing the burglar bar assembly by remote operating means.

BACKGROUND OF THE INVENTION

Burglar bar assemblies or security barriers formed of metal or other rigid force resistant material are commonly employed to prevent or deter unauthorized entry of persons through openings in buildings which has windows or doors. In general many such burglar bar assemblies have heretofore been fixed barriers standing across the inside or the outside of a window, for instance, or if not fixed have been incapable of quick release and removal whereby they pose a serious hazard to persons wishing to use the door or window openings for an escape route in the event of fire or some similar disaster.

Consequently, need has arisen for a convenient and dependably operable means for readily releasing such burglar bar assemblies for removing the barrier formed thereby from across a window or door opening in the event of an emergency while at the same time maintaining the intended security barrier function.

BRIEF SUMMARY OF THE INVENTION

In brief, the present invention is directed to the provision of an improved latch system for quickly and conveniently releasing a burglar bar assembly from its security barrier position across a window or door opening. To that end, the present invention presents an improved remotely operable latching system capable of securing one end of a hingedly moveable burglar bar assembly having a plurality of horizontal cross bars held in vertically spaced relation by transverse vertical members in closed position across a window or door opening. The improved latch system of this invention comprises a locking channel secured to one vertical frame member of a window or door opening and which locking channel is distinguished by a plurality of downwardly angulated slotted openings receptive of the horizontal bar members of the burglar bar assembly. A pivotally mounted cam member is located adjacent at least one of such angulated slots and is normally biased by spring means to a locking position whereat a horizontal bar is locked in one of the said slots. An operating cable is attached at one end to the cam member and serves to pivotally actuate the latter against spring bias. The cable is attached at its other end to a remotely positioned lever system capable of tensioning the cable to effectuate the referred to pivotal activity of the cam whereby to release the bars from the angulated slots of the locking channel. Due to the downwardly angulated disposition of the several bar receiving slots of the locking channel, opening or releasing activity of the cam permits the bar assembly to quickly escape the slots and automatically swing open under the force of gravity.

It is a principle object of this invention to provide a new and improved safety latch system for use with burglar bar assemblies for locking and releasing the same from a security barrier position across a window, door or other opening in a building structure.

It is a further object of this invention to provide an improved safety latch as set out in the preceding objective which is operable in response to a remotely located operating means.

It is still another object of this invention to provide an improved safety latch system for use with burglar bar assemblies which is operable to positively lock the burglar bar assembly in a security barrier position across a window or door opening and which is automatically responsive to closing movement of the burglar bar assembly to lock the latter in closed security barrier position on impact engagement with the bar assembly.

Having described this invention the above and further objects, features and advantages thereof will be readily recognized by those familiar with the art from the following detailed description of a preferred embodiment thereof, illustrated in the accompanying drawings and representing the best mode presently contemplated for enabling those with skill in the art to practice this invention.

IN THE DRAWINGS

FIG. 2 is a rear elevational view of the burglar bar assembly shown in FIG. 1 as it appears in its opened position;

FIG. 3 is a top plan view taken substantially from vantage line 3—3 of FIG. 1 looking in the direction of the arrows thereon;

FIG. 4 is a cross sectional view taken substantially along vantage line 4—4 of FIG. 1 and looking in the direction of the arrows thereon;

FIG. 5 is a foreshortened, partial side elevation of the locking channel taken substantially along vantage line 5—5 of FIGS. 3 and 4 and looking in the directions of the arrows thereon;

FIG. 6 is a foreshortened, partial side elevation, of the security cover which cooperates with the locking channel of FIG. 5, viewed from vantage line 6—6 of FIGS. 3 and 4 and looking in the direction of the arrows thereon;

DESCRIPTION OF THE PREFERRED EMBODIMENT

Figure 1:
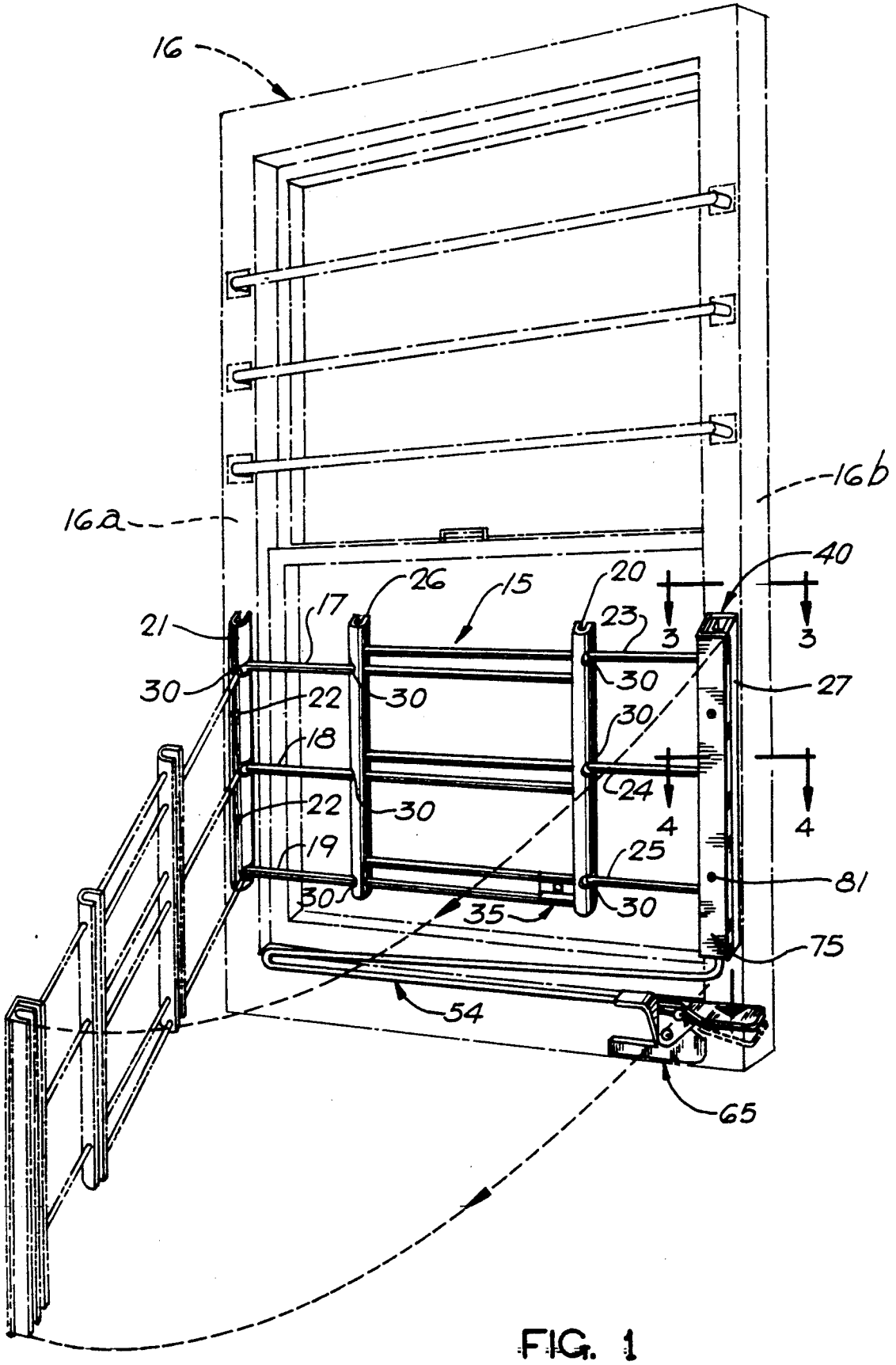
FIG. 1 is a perspective illustration of a typical window installation for a burglar bar assembly in accordance with this invention and indicating the open position therefor in dotted line.

With initial reference to FIG. 1 of the drawings, it will be recognized that a burglar bar assembly, indicated generally at 15, is adapted to be mounted across an opening defined by a conventional window frame 16 (indicated in dotted lines) representative of a typical environment for installation of this invention. Assembly 15 is shown in full lines mounted across the opening of frame 16 and in a dotted line open position in FIG. 1. Assembly 15 comprises two slidably interfitted bar subassemblies, the first of which comprises three horizontal rods or bars 17, 18 and 19 which are fixed at one end to a vertical spacer member 20 and hingedly joined at their opposite ends to a combined vertical anchor and hinge post 21 adapted to be fixed to one vertical side jamb member 16*a* of the window frame as by attachment screw members 22. Such subassembly comprising the members 17–21 is slidably coupled to a similar bar and vertical spacer member subassembly comprising horizontally extending rods or bars 23, 24 and 25 fixed at one end to vertical spacer member 26 and at their opposite ends to a similar vertical spacer member 27 located opposite the right hand lateral frame member 16*b* of the window frame.

It will be noted that the four vertical spacer members 20, 21, 26 and 27 are substantially identical and are generally of U-shaped cross sectional configuration (see FIG. 3) to provide opposing spaced walls 28 and 29 which are suitably pierced with cylindrical openings receptive of the horizontal rod members 17–19 and 23–25. In addition the two vertical members 20 and 26 are provided with elongated, horizontal openings 30 in one wall thereof which are opposed by cylindrical pierced openings in the opposite wall thereof for the sliding passage of associated horizontal rods. In the case of the vertical member 20, the openings 30 slidably receive rods 23, 24 and 25 while the vertical member 26 slidably receives the rod members 17, 18 and 19 therethrough.

The jamb mounted vertical post 21, similarly is provided with elongated openings 30, receptive of end portions 31 which are upturned at right angles to the body of rods 17–19 to formulate hinge pintles whereby to effect hinge connection between one end of the subassembled rods 17–19 and the jamb mounted vertical post member 21. The opposite ends of the several rods 17–19 are fixed as by welds 32 to the vertical spacer member 20 (see FIG. 2). In a similar fashion the outer ends of the rods 23–25 are fixed to one wall of the vertical members 26 and 27 as by weld connections, indicated at 33 in FIG. 2.

Thus the two subassemblies of rod and vertical members are slidably interjoined whereby to selectively accommodate the distance between the jamb members 16*a* and 16*b* of the window frame. Once the desired width of the burglar bar assembly 15 is determined, two adjacent rods of the opposing subassemblies of the burglar bar, such as rods 19 and 25, are positively interlocked by a bar clamp assembly 35 comprising a pair of conveniently gripping plate members held together by a central fastener in accordance with known practice.

It is to be recognized that while a specific extensible burglar bar assembly 15 has been heretofore described, such is illustrative of the context in which the improved latch assembly of this invention is useful and which is intended to be applicable to any equivalent non-extensible burglar bar assembly made up of a plurality of horizontal rods and vertical spacer members mounted for hinged movement about one end thereof.

Turning now to the aspects of the improved latch assembly of this invention, particular attention is directed to FIGS. 1 and 3–10 of the drawings.

As generally illustrated in FIG. 1 of the drawings, the latch assembly of this invention is located at the right hand end of the closed burglar bar assembly 15 and is adapted in operation to secure the free or non-hinge connected end of the burglar bar assembly to the window frame member 16*b*, as will appear in greater detail presently.

As shown, the improved latch assembly of this invention comprises a locking channel member 40 formed as an elongated metal member (see FIGS. 7 and 9) having right angularly related planar legs 41 and 42 which are rigidified in their right angular relationship by an intervening angularly disposed reinforcing plate 43 located intermediate the ends thereof. Leg 41 of the locking channel is adapted to be secured to the side frame member 16*b* of the window frame as by a plurality of elongated screw fasteners or bolts, indicated at 44 in FIGS. 3 and 4 whereby to secure the locking channel in an upright, vertical position parallel to mounted hinge post 21.

The planar leg 42 of the locking channel 40 is particularly distinguished by a pair of angularly inclined slotted openings 45 and 46 extending inwardly and upwardly of an outer edge 47 thereof and oriented substantially at 45° to the horizontal. Slotted opening 45 is adjacent the upper end of leg 42 while the slotted opening 46 is disposed generally medially of the length thereof with the spacing between the openings 45 and 46 matching the spacing between the rod members 23 and 24 of the bar assembly. Such slotted openings 45 and 46 are adapted to receive the bars 23 and 24 therein when the burglar bar assembly is located in its closed position across the window frame as will be amplified presently.

Mounted intermediate the ends of the leg 42 immediately adjacent, but below the slotted opening 46, is a pivotally mounted latching cam 50 comprising a plate member supported on a single pivot member 51 secured to the body of leg 42 and extending through a suitable opening therefor in the latching cam 50 whereby the latter is rotatable about the axis of the pivot member 51. In practice the pivot member 51 may comprise a rivet extending through leg 42 and suitably riveted over at its outer end to secure the locking cam 50 in position.

Extending from the outside face of the cam 50, generally opposite the pivot 51 is an anchor pin 52 which stands outwardly from the planar body of the cam member 50 and rotatably receives and secures in place an anchor fitting 53 to which one end of an actuator cable 54 is secured. Cable 54 is guided in axial alignment with pin 52 by means of a pair of spaced guide members 55, 55 fastened to the adjacent face of leg 42, as by rivet means 56. Also secured to the anchor pin 52 is one end of a tension spring 60 having the opposite end thereof trained about an upstanding post 61 fixed to leg 42 and located immediately below the gusset or reinforcing plate 43, as best viewed in FIGS. 7 and 9. It will be appreciated that spring 60 serves to normally bias the cam member 50 in a counterclockwise direction as viewed in FIG. 7 while the tensioning of the cable 54 serves to bias such cam member in an opposite or clockwise direction (see FIG. 9). To that end the spring 60 and cable 54 are coaxially aligned and commonly joined to the cam mounted anchor pin 52 as heretofore related. It is to be noted that cam 50 has two camming edge surfaces 62 and 63 for reasons to be described hereinafter.

Figure 7:
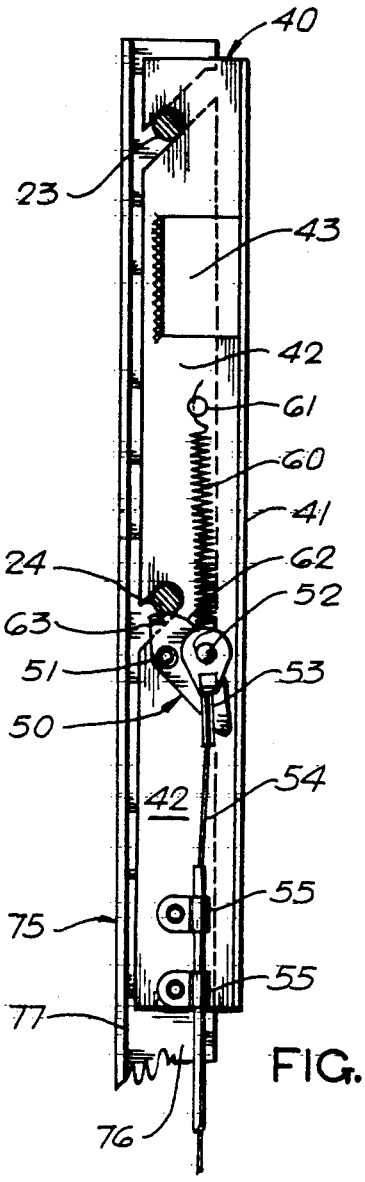
FIG. 7 is a right hand side elevation of the locking channel and security cover as viewed along vantage line 7—7 of FIG. 4, looking in the direction of the arrows thereon and showing the latch mechanism in its locking position.
Figure 9:
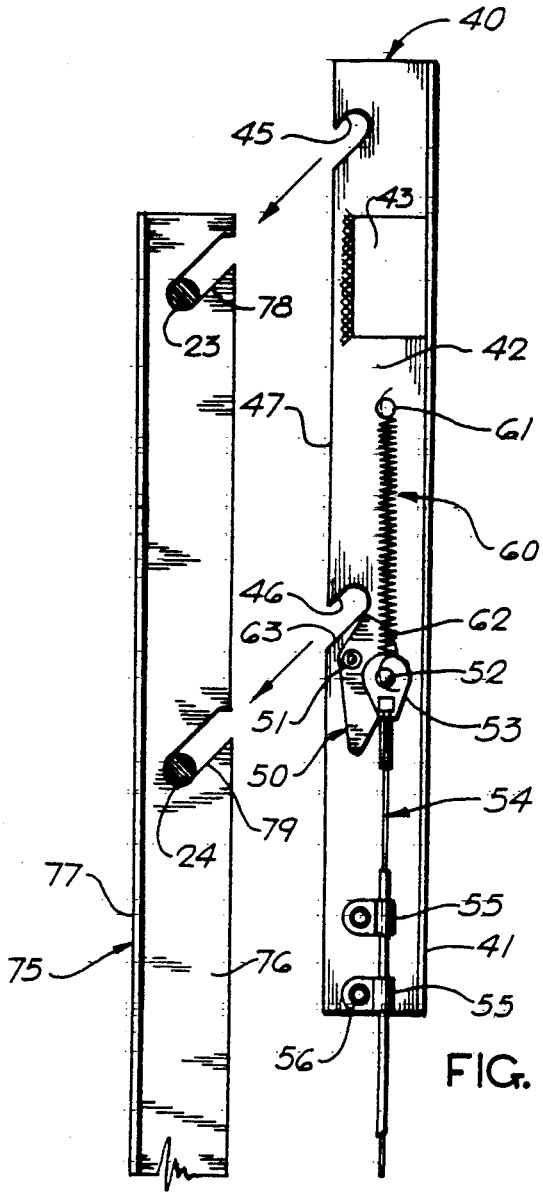
FIG. 9 is a side elevation, similar to FIG. 7 and taken substantially along vantage line 9—9 of FIG. 4 and looking in the direction of the arrows thereon, and illustrating the locking channel and security cover in the unlatched position.
Figure 8:
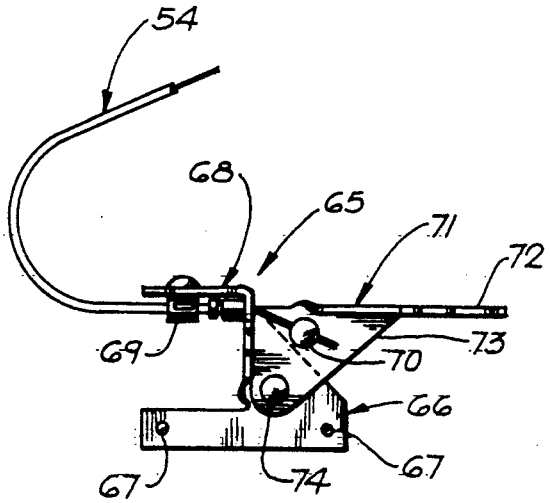
FIG. 8 is a front elevation of a remote latch operating lever assembly conditioned for retaining the latch mechanism of FIG. 7 in its locked position.
Figure 10:
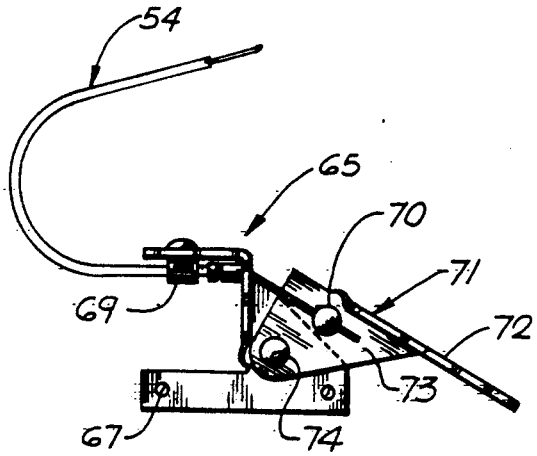
FIG. 10 is a front elevation of the latch operating lever of FIG. 8 conditioned for retaining the latch mechanism in an open or unlocking position.

Operation of the cable 54 is in response to activation of a remote operating lever assembly 65, shown best in FIGS. 1, 8 and 10 of the drawings, which is adapted to be mounted at a location remotely of the burglar bar and window frame, such as the adjacent base board of the attendant room or, in any event, in position not readily accessible to possible intruders. To this end the assembly 65 comprises a planar mounting plate 66 adapted to be secured to a suitable support as by screw member 67 passing through the body of plate 66. The mounting plate is further distinguished by an integral right angularly related bracket portion 68 at one end for carrying cable guide means 69 through which the cable 54 is trained. The end of the cable 54 which is not joined to cam 50 is anchored as by rivet means 70, to one face of a pivotally moveable operating lever member 71 having an operating arm 72 extending outwardly from a triangular shaped body 73 thereof which is pivotally secured at one corner to an outside face of the mounting plate 66 by rivet means 74. With this arrangement downward pivotal movement of the operating lever 71, between its FIG. 8 and 10 positions, serves to tension cable 54 whereby to rotate the locking cam 50 in a clockwise direction so that the cam assumes its unlocking condition as shown in FIG. 9. Conversely upon release of the lever 71 the spring means 60 serves to pull on cable 54 causing lever 71 to move into its normal non-actuated position as viewed in FIG. 8. This causes the cam plate to rotate in a counterclockwise direction and assume its locking condition, as illustrated in FIG. 7 of the drawings.

It will be recognized that with lever 71 in its FIG. 8 position, cable movement is limited by the interengagement of lever 71 and the bracket portion 68. This limits counterclockwise movement of cam 50 and maintains it in its FIG. 7 position. It will be understood as well, that when rod 24 is bottomed in slot 46, counterclockwise movement of the cam 50 to its FIG. 7 locking position causes cam surface 62 thereof to wedge and hold bar 24 in slot 46, preventing its removal until released by releasing movement of the cam 50.

In order to prevent an intruder from reaching around the arm 42 of the locking channel and actuating the cam 50 to an unlocked condition a security cover 75 is provided comprising an elongated right angularly cross sectioned channel member, similar to the locking channel 40 comprising two right angularly related planar flange walls 76 and 77 as best illustrated in FIGS. 3 and 4 of the drawings. The security cover, as shown in FIGS. 1, 7 and 9, is longer than the locking channel 40 and has the flange wall 76 thereof formed with three angulated slotted openings 78, 79 and 80 (see FIGS. 2) receptive of the bar members 23, 24 and 25 respectively. Such slotted openings 78–80 match the spacing between the horizontal rods 23, 24 and 25 and are oriented at substantially 45° to the horizontal in an upward slopping direction for registering alignment with the slots 45 and 46 of the locking channel. Flange wall 77 of the security cover 75 is of somewhat greater lateral extent than the bar receiving flange wall 76 thereof, as will best be understood from FIGS. 2, 3 and 4 of the drawings. The cover 75 is fixed or otherwise secured to the vertical spacer member 27 by attachment screw fasteners 81 so as to extend laterally past the vertical spacer 27 and overcover the same, while embracing the horizontal rods 23–25 via slotted openings 78–80 thereof such that when the burglar bar assembly is in closed position as illustrated in FIGS. 3 and 4, for example, the leg 42 of the locking channel is overcovered by flange wall 76 of the security cover and the locking cam and its attendant mechanism is inaccessibly enclosed by the interfitting relationship of the locking channel, security cover and vertical spacer member 27. This secure position will best be understood by examining FIG. 4 of the drawings.

With reference to FIGS. 5 and 6 of the drawings, it will be understood that when the opened burglar bar assembly 15 (as shown in dotted lines in FIG. 1) approaches the cam mounted locking channel 40 as indicated in FIG. 5, rods 23 and 24 which are to enter slots 45 and 46 respectively of the locking channel, reside at a lower elevation due to the open slotted hinged structure supporting the left hand end of the burglar bar assembly, i.e., vertical member 21, slotted openings 30 and pintle portions 31 which permit the gate or burglar bar assembly to hang at a downward slope in its open position. As the horizontal rods 23 and 24 are raised into the slots 45 and 46, respectively, it will be seen from FIG. 5 that the locking cam 50 resides in its locking position across slot 46 due to the activity of the tension spring 60 as heretofore related. Movement of the rods 23 and 24 into the locking channel slots however, causes rod 24 to engage cam surface 63 of the locking cam to rotate the same against the biasing force of the spring means 60 and thereby permitting rod 24 to pass cam 50 and bottom in the slotted opening 46. The cam 50, under the urging of the spring 60 then returns to its locking position as indicated in FIG. 5 and in FIG. 7, to hold rod 24. Thus the latching system of this invention provides for automatic closing movement of the burglar bar assembly and automatic latching activity of the latch system. Unlatching operation of the cam 50 and the release of the bar 24 from slot 46 contrastingly requires positive activity of the latch assembly 65 in the manner heretofore related.

It is to be noted that from FIG. 7 in particular that when the burglar bar assembly 15 is secured in its locking condition with the locking channel 40, the lowermost bar 25 (not shown in FIG. 7) resides beneath the lower extremity of the locking channel in the particular illustrated embodiment. If preferred, channel 40 may be extended and provided with an additional slotted opening to receive bar 25 in the manner that the bars 23 and 24 are received in slotted openings 45 and 46, respectively. In practice such third slotted opening in the locking channel has not been found to be necessary for securing of the burglar bar assembly in a closed barrier position.

From the foregoing it is believed that those familiar with the art will readily recognize and appreciate the novel advancement of this invention over the art and will further understand that while the same has been described herein in association with a preferred embodiment thereof, illustrated in the accompanying drawings, the same is nevertheless susceptible to variation, modification and substitution of equivalents without departing from the spirit and scope of the invention which is intended to be unlimited by the foregoing except as may appear in the following appended claims.

The embodiments of the invention in which an exclusive property or privilege is claimed are defined as follows:

1. A burglar bar assembly operable to form a security barrier over the opening of a window or door frame, comprising:

plural, rigid, horizontally oriented rod members held in spaced parallelism by plural intervening rigid, laterally spaced, vertical spacer members; one of said spacer members being attachable to a first vertical member of said frame and having hinged connection with the said rod members at one end of said assembly; a second of said spacer members being fixed to said rod members at the non-hinged end of said assembly; a locking channel mountable to a second vertical member of said frame in opposing parallelism to said one spacer member; said locking channel having two right angularly related planar legs, one of which is attachable to said second vertical member and the second of which projects outwardly from the latter at a location to interferingly engage said rod members adjacent said second of said spacer members when the bar assembly is swung toward a closed condition across said frame; said second of said legs having multiple slotted openings extending inwardly of one outer edge thereof and inclined upwardly to the horizontal for receiving said rod members therein; and latch means mounted adjacent at least one of said slotted openings and comprising a pivotally mounted locking cam operable to move beneath a said rod member in said one of said openings whereby to capture the same and prevent its escape from said one of said openings.

2. The combination of claim 1, and cable means attached to said cam, a remotely located operating lever for tensioning said cable to move said cam out of its rod capturing position, and spring means attached to said cam for normally biasing the same into its rod capturing position.

3. The combination of claim 2, wherein said spring and cable means are coaxially aligned and pivotally connected to said cam, and said operating lever is attached at one end of said cable remotely of said bar assembly for moving the cam against the biasing force of said spring means.

4. The combination of claim 1, wherein said cam is formed with a first cam surface adapted to under engage a said rod in said one of said slotted openings with wedging action.

5. The combination of claim 4, wherein said cam is normally spring biased into its rod capturing position across said one of said slotted openings, and a second cam surface formed on said cam, located for engagement by a said rod entering said one of said slotted openings and operable to effect movement of said cam to its non-rod capturing position.

6. The combination of claim 1, wherein the inclined orientation of said slotted openings causes said rods to gravitational escape from said locking channel when said cam is moved out of its rod capturing position.

7. The combination of claim 1, and a security cover adapted to be attached to said second vertical spacer member and comprising a right angle channel member having slotted openings in one flange wall thereof which are receptive of said rod members and a laterally extending second flange wall capable of protectively covering said locking channel and latch means when the burglar bar assembly is locked in its closed position across said frame.

* * * * *